US006287347B1

(12) United States Patent
Krack et al.

(10) Patent No.: US 6,287,347 B1
(45) Date of Patent: Sep. 11, 2001

(54) METHOD FOR WASHING CLOTHES

(75) Inventors: Ralf Krack, Duesseldorf; Alfred Laufenberg, Dormagen; Joerg Brockhaus, Duisburg; Christine Schnepf, Neuss; Thomas Merz; Dietmar Rossner, both of Hilden, all of (DE)

(73) Assignee: Henkel Ecolab GmbH & Co OHG, Duesseldorf (DE)

( * ) Notice: Subject to any disclaimer, the term of this patent is extended or adjusted under 35 U.S.C. 154(b) by 0 days.

(21) Appl. No.: 09/355,287

(22) PCT Filed: Jan. 20, 1998

(86) PCT No.: PCT/EP98/00276

§ 371 Date: Oct. 18, 1999

§ 102(e) Date: Oct. 18, 1999

(87) PCT Pub. No.: WO98/32908

PCT Pub. Date: Jul. 30, 1998

(30) Foreign Application Priority Data

Jan. 29, 1997 (DE) ..... 197 03 086

(51) Int. Cl.[7] ..... D06F 31/00; D06F 35/00

(52) U.S. Cl. ..... 8/137; 8/141; 210/650; 210/652; 210/660; 210/195.2; 210/257.2

(58) Field of Search ..... 8/137, 141; 210/650, 210/652, 660, 195.2, 257.2

(56) References Cited

U.S. PATENT DOCUMENTS

| | | | | |
|---|---|---|---|---|
| 4,720,345 | * | 1/1988 | Linder et al. | 210/650 |
| 5,310,486 | * | 5/1994 | Green et al. | 210/638 |
| 5,520,816 | * | 5/1996 | Kuepper | 210/649 |
| 5,587,083 | * | 12/1996 | Twardowski | 210/652 |

FOREIGN PATENT DOCUMENTS

| | | | |
|---|---|---|---|
| 0 467 028 | | 1/1992 | (EP) . |
| 0578006 A1 | * | 1/1994 | (EP) . |
| 578006 A1 | * | 1/1994 | (EP) . |
| 0 578 006 | | 1/1994 | (EP) . |
| WO 98/21303 | * | 5/1998 | (EP) . |
| WO 98/21303 | | 5/1998 | (WO) . |

* cited by examiner

*Primary Examiner*—Lorna M. Douyon
*Assistant Examiner*—Brian P. Mruk
(74) *Attorney, Agent, or Firm*—Wayne C. Jaeschke; Glenn E. J. Murphy

(57) ABSTRACT

A method of washing textiles in an institutional washing machine wherein soil-containing wastewater is regenerated through a nanofiltration membrane and recycled to the washing process.

6 Claims, No Drawings

METHOD FOR WASHING CLOTHES

This invention relates to a process for washing laundry, more especially occupational clothing, in which the laundry is washed with a conventional detergent composition in a conventional institutional washing machine and the wastewater is treated in a membrane unit.

Occupational clothing and other linen from hotels and guesthouses, hospitals, from the food industry, for example abattoirs, butcher's shops, etc., and textiles and occupational clothing from the automotive sector are mainly washed in institutional laundries. The soils occurring in occupational clothing and in the institutional sector frequently lead to particularly serious pollution of the wastewater. Efforts are made to treat the wastewater from institutional laundries by removing the pollutants. Depending on the soil and pollutant levels, the treated water may be discharged into the wastewater system or reused in the washing process, for example in a prewash or rinse cycle.

The membrane units in use today employ ultrafiltration and microfiltration membranes. Unfortunately, a considerable percentage of dissolved organic compounds and dissolved heavy metals is not removed from the wastewater in these units. Although the treated wastewater is clean enough to be discharged into the public wastewater system, it is not clean enough to be reused in the washing process.

Accordingly, the problem addressed by the present invention was to provide a process for washing laundry, more especially occupational clothing, in which the water would be treated to such a high degree of purity that it could be returned to the washing process without affecting washing performance.

Accordingly, the present invention relates to a process for washing laundry, more especially occupational clothing, in which the laundry is washed with a conventional detergent composition in a conventional institutional washing machine and the wastewater is treated in a membrane unit, characterized in that the wastewater is passed through a nanofiltration membrane, separated into a soil-enriched concentrate and a soil-depleted regenerate and the regenerate is returned to the washing process.

It has surprisingly been found that the use of nanofiltration membranes for treating the wastewater leads to a treated (recycled) water —also referred to as the regenerate or permeate—which can be used in other washing processes, for example in the prewash or as rinsing water. In addition, it has been found that even divalent ions, such as $Ca^{2+}$ ions and heavy metal ions, are retained by the membrane used so that there is no need to soften fresh water. By virtue of the water-softening effect and the re-use of the treated wastewater, the water demand of washing processes and the overall costs of the washing process can be clearly reduced.

The process according to the invention is particularly suitable for treating wastewater in institutional laundries where, for example, hospital and hotel laundry and occupational clothing is washed.

Nanofiltration membranes with a cutoff (retention capacity, based on the molecular weight of the retained substance) of 100 to 1,000 and preferably 150 to 500 have proved to be suitable as membranes. Because the cleaning solutions generally used are alkaline, the wastewater also is generally alkaline so that the membranes should preferably be alkali-stable. Membranes based on organic polymers and ceramic materials are normally used. Particularly suitable membranes are nanofiltration membranes based on organic polymers which are commercially available from Membrane Products Kyriat Weizmann, Rehovot, Israel.

The washing machines presently in use in institutional laundries do not have to be modified to accommodate the process according to the invention, neither do the detergent compositions used. The soiled laundry is washed in a conventional machine, the wastewater obtained in the particular washing or rinsing step being delivered to a membrane unit and then subjected to the separation process according to the invention. To this end, the wastewater is preferably first collected in a recycling tank. All or only part of the wastewater of a washing machine can be treated.

Where the process according to the invention is applied, the wastewater can be directly delivered to the nanofiltration membrane unit. The wastewater does not have to be subjected to pretreatment by micro- or ultrafiltration although such a pretreatment before the process according to the invention is carried out is not out of the question.

The separation process according to the invention using the nanofiltration membrane unit separates the wastewater into a soil-enriched concentrate and a soil-depleted regenerate which still largely has the acid or alkali content of the wastewater.

After purification in nanofiltration membranes, the regenerate may be passed through an ion exchanger to remove any membrane-permeable impurities present, for example water-soluble salts and ions, especially heavy-metal ions and monovalent ions. The closed water circuit which is made possible by the process according to the invention can lead to a concentration of monovalent ions so that ion exchangers may have to be used. Suitable ion exchangers are commercially available ion exchangers suitable for water treatment.

The percentage of the wastewater which can be separated by such a membrane process into a reusable regenerate (permeate) and a disposable concentrate (retentate) depends on the nature and degree of soiling. In general, around 60% by volume to around 95% by volume of the wastewater can be converted into regenerate under simulated practical conditions. The process as a whole is more economical, the greater the volume of regenerate obtained and returned to the washing process.

The soil-enriched concentrate, which can have a solids content of— for example—around 25% by weight to around 35% by weight, is preferably separately disposed of, for example by burning or by biological degradation, for example in a digestion tower. The concentrate obtained may also be added to the normal process wastewater.

The temperature of the wastewater or rather the soil-laden wastewaters collected in a recycling tank generally does not have to be adjusted to a particular value for the separation process. Instead, the temperature prevailing in the particular wash or rinse cycle may be retained. In order to avoid additional energy consumption, the wastewater or rather the wastewater collected in the recycling tank may be subjected to the separation process at whatever its particular temperature is.

EXAMPLES

Example 1

Cleaning Performance of the Membranes

The wastewater from an institutional laundry was passed through a membrane filtration unit (nanofiltration membrane MPT 34, manufacturer: Kyriat Weizmann) with an entry pressure of 17 bar and an exit pressure of 14 bar.

The conductivity and the COD value of the feed water and treated water (permeate) were measured. The results are set out in Table 1.

Table 1 shows that, over the measurement period, the permeate has a distinctly lower oxygen demand than the wastewater delivered to the filtration unit before the treatment (feed). Whereas the conductivity of the wastewater increases, the conductivity of the permeate remains substantially constant. These results show that the permeate is suitable for reuse in other washing processes.

TABLE 1

| Time | COD [mg $O_2$/l] | | Conductivity [mS] | | Membrane performance |
|---|---|---|---|---|---|
| [mins.] | Feed | Permeate | Feed | Permeate | [l/hm$^2$] |
| 1 | 2200 | 0 | 18 | 10.5 | 50 |
| 15 | 2750 | 0 | 20 | 5 | 48 |
| 60 | 3000 | 100 | 23 | 4 | 44 |
| 120 | 4800 | 100 | 30 | 4.5 | 38 |
| 160 | 5900 | 150 | 38 | 8 | 37 |
| 220 | 7100 | 160 | 42.5 | 8.5 | 34 |
| 330 | 8800 | 160 | 47 | 9 | 31 |
| 450 | 9400 | 180 | 52 | 9.5 | 30 |
| 600 | 11800 | 200 | 57 | 10 | 29 |

Example 2

Reuse of the Permeate in the Washing Process

Tests were conducted to determine the influence of water treated in accordance with Example 1 on the washing performance of institutional washing machines in removing various standardized soils from cotton cloth and from crease-resistant polyester/cotton blend.

Standard laundry consisting of 4.5 kg overalls, 3.0 kg terry and SAM as used as the test laundry Silex® perfekt (Henkel KGaA) was used as the detergent in the first wash cycle at 50° C. (dose: 20 g/kg) while Silex® perfekt (15 g/kg) and Ozonit® (bleach booster made by Henkel KGaA, dose: 10 ml/kg) were used in the second wash cycle at 70° C. In both wash cycles, permeate was used as the washing water. The laundry was then rinsed 5 times. In the first rinse cycle, permeate was used in the tests according to the invention. In the comparison test, fresh water was used both in the wash cycle and in the rinses.

The color difference values of the soils was measured with the CIELAB system by determining the LAB value of the laundry both before and after washing.

L represents the lightness of the laundry (L=0=black and L=100=white), A represents the change in color from red to green and B the change in color from green to blue. The measured color difference value is called the delta delta E-value.

The color difference values are shown in Table 2. In Table 2, FW means that the washing process was carried out with fresh water while Recycl. 1 and Recycl. 2 mean that the first and second wash cycles and the first rinse cycle were each carried out with permeate.

The values set out in Table 2 show that the cleaning effect is not impaired by the use of treated water. The color difference values of the soiled laundry which was washed with treated water (permeate) in the first rinse cycle are comparable with the values obtained using fresh water.

TABLE 2

| | Color difference value delta delta E | | | | | |
|---|---|---|---|---|---|---|
| | Cotton | | | Crease-resistant polyester/cotton blend | | |
| Soil | FW | Recycl. 1 | Recycl. 2 | FW | Recycl. 1 | Recycl. 2 |
| Lipstick | 48 | 51 | 52 | 60 | 64 | 59 |
| Make-up | 31 | 35 | 34 | 37 | 42 | 39 |
| Olive oil/Sudan blue | 18 | 15 | 15 | 16 | 14 | 15 |
| Mascara | 29.5 | 30.5 | 30.5 | 36 | 35 | 35.5 |
| Watch oil/SH paste | 30 | 31 | 31 | 31 | 32 | 31 |
| Curry/ketchup | 50 | 51 | 50.5 | 48 | 48.5 | 47.5 |
| Red currant juice | 25 | 25.5 | 25.5 | 22 | 21 | 21 |
| Coffee | 22 | 22.5 | 23 | 19 | 19 | 19 |
| Red wine | 17 | 17 | 17 | 16 | 16 | 16 |
| Tea | 15 | 16 | 16 | 15 | 15 | 15 |
| Blood/milk/soot | 17 | 20.5 | 23 | 15 | 25 | 26 |
| Egg/soot | 27.5 | 28 | 30 | 22 | 22 | 23 |
| Oat flakes/cocoa | 31 | 31 | 31 | 33 | 32 | 31 |
| Milk/cocoa | 38 | 40 | 40 | 45 | 46 | 45 |

Example 3

Incrustations

In addition, a multiple wash program (for washing conditions, see Table 2) was carried out. A WFK control fabric (standard fabric of the Wäscheforschungsanstalt Krefeld) was used in these tests.

The results obtained satisfied all the relevant quality standards.

What is claimed is:

1. A process for washing a textile, comprising the steps of:

a. in an institutional washing machine, contacting a soiled textile with an aqueous wash liquor comprising a detergent and water, whereby the soil is at least partially removed from the textile and enters the wash liquor to form a wastewater;

b. passing the wastewater through a nanofiltration membrane to form a soil-enriched concentrate and a soil-depleted regenerate; and c. returning the regenerate to the wash liquor.

2. A process according to claim 1 wherein the membrane has a retention capacity of 100 to 1000.

3. A process according to claim 2 wherein the membrane has a retention capacity of 150 to 500.

4. A process according to claim 1 wherein the membrane comprises an organic polymer or a ceramic material.

5. A process according to claim 1, wherein regenerate is passed through an ion-exchanger before being returned to the wash liquor.

6. A process according to claim 1 wherein the regenerate comprises 60% to 95% by volume of the wastewater.

* * * * *